United States Patent [19]

Begey et al.

[11] Patent Number: 4,864,743

[45] Date of Patent: Sep. 12, 1989

[54] HEEL BLOCKING DEVICE FOR SKI BOOT

[75] Inventors: Jean-Marie Begey, Cranves-Sales; Jean-Pierre Chemello, Annecy, both of France

[73] Assignee: Salomon S.A., Annecy Cedex, France

[21] Appl. No.: 69,797

[22] Filed: Jul. 6, 1987

[30] Foreign Application Priority Data

Jul. 4, 1986 [FR] France ..... 86 10235

[51] Int. Cl.[4] ..... A43B 5/04; A43B 7/14

[52] U.S. Cl. ..... 36/119; 36/88; 36/89; 36/92

[58] Field of Search ..... 36/117–121, 36/93, 88, 71, 89, 92

[56] References Cited

U.S. PATENT DOCUMENTS

| | | | |
|---|---|---|---|
| 3,803,730 | 4/1974 | Hanson et al. | 36/117 |
| 3,945,135 | 3/1976 | Hanson et al. | 36/121 |
| 4,030,214 | 6/1977 | Hanson et al. | 36/118 X |
| 4,203,235 | 5/1980 | Van Pelt, Jr. | 36/121 X |

FOREIGN PATENT DOCUMENTS

| | | | |
|---|---|---|---|
| 0014124 | 8/1980 | European Pat. Off. | 36/118 |
| 0209856 | 1/1987 | European Pat. Off. | 36/117 |
| 2839418 | 6/1982 | Fed. Rep. of Germany . | |
| 3527135 | 1/1987 | Fed. Rep. of Germany | 36/119 |
| 1006263 | 1/1952 | France . | |
| 2180315 | 11/1973 | France . | |
| 1069934 | 5/1976 | Italy . | |
| 365972 | 1/1963 | Switzerland . | |

*Primary Examiner*—James Kee Chi

*Attorney, Agent, or Firm*—Pollock, Vande Sande & Priddy

[57] ABSTRACT

Ski boot comprised of a rigid shell at least partially surmounted by an upper (4) and at least one padding element (9) inside the boot intended to block the skier's foot. The boot comprises a blocking device (12) having a block (16, 16') extending from each side of the zone of the Achilles tendon into the hollow of the malleoli located above the protuberance of the calcaneum, and the block is attached to a block holder (14) provided with a height adjustment device (17, 17'), arranged along the median vertical axis of the back of the upper.

26 Claims, 7 Drawing Sheets

FIG.9 bis

HEEL BLOCKING DEVICE FOR SKI BOOT

FIELD OF THE INVENTION

This invention pertains to downhill ski boots and more specifically involves devices to block the heel in the boots.

BACKGROUND OF THE INVENTION

The heel is traditionally blocked using padding attached inside the boot upper. For example, the boots described in French Pat. No. 1,006,263 and U.S. Pat. Nos. 2,531,763 and 1,055,295 can be cited. In these boots, paddings are made unitary with the inside slipper of attached thereto with glue, by sewing, soldering, or the like, so that it is not possible to adjust their position precisely according to the morphology of the foot.

Other shoes, such as those disclosed in Swiss Pat. No. 365,972 and French Pat. No. 2,180,315, comprises devices to clamp the heel. These devices enclose the heel from the upper rear part thereof to the lower zone of the malleoli. In these different boots, only the clamping (or pinching) value of the heel can be adjusted by means of a buckle, tightener, or pressurized air pocket.

One can further cite other boots in which heel blocking plates extend on both sides of said heel, bypassing the malleoli, as described in Italian Pat. No. 1,069,934. These blocking plates are associated with the inside slipper by introduction into pockets provided in the latter for this purpose. In the examples set forth in German Pat. No. 2,839,418 and U.S. Pat. No. 2,763,071, the blocking plates can be adjusted by moving them closer to the heel inside the boot, using mechanical systems.

However, all of these devices only have one capability of blocking and/or clamping the heel in the boots, without the possibility of precise adjustment in the vertical plane with respect to the rear protuberance of the calcaneum. Moreover, most of the clamping devices described are inclined to maintain pressure on the heel, tending to push the latter towards the front of the boot, which involves the problem of decreasing the rear support of the base of the leg against the rear part of the upper.

SUMMARY OF THE INVENTION

The device according to the invention proposes an upward and lateral blocking of the heel by adjusting the rear part of the boot upper at the protuberance of the calcaneum on both sides of the Achilles tendon. The device also makes it possible to conform the rear part of the upper to the corresponding part of the base of the leg and thus solve the aforementioned problems.

For this purpose, the device is placed between the rear support padding for the base of the leg and the wall of the upper, and comprises a block holder which bypasses the Achilles tendon and is provided with at least two blocks which extend respectively from each side of the Achilles tendon in the upper zone of the protuberance of the calcaneum approximately up to the corresponding malleolus. Height adjustment means are provided on the block holder to cooperate with at least one stop element defining a given position on the rear part of the upper.

According to different embodiments, the block holder can be connected to the rear support padding of the boot upper or to the wall of said upper, of even to both at once, through the intermediary of the stop element.

Depending on the case, the block holder is comprised of a transverse bar mounted on a median tongue. The ends of the transverse bar are each provided with a blocking element, while the median part comprises the means to adjust the height along the rear part of the boot upper.

In most cases, these adjustment means are intended to cooperate with at least one element to stop or fasten the block holder in place, and said stop element can be either fixed in position on the rear part of the upper, the rear padding, the block holder itself, or its position can be movable and/or adjustable.

Various embodiments of ski boots comprising such blocking devices are possible. Thus, for example, the device can be adapted to a "rear opening" boot in which the rear part, more commonly called the "spoiler" in the field of ski boots, can be pivoted rearwardly so that the foot can be introduced. By bringing this rear part, or spoiler, towards the front upper, which itself is more commonly called the "collar", the boot can be closed, holding the base of the leg and the foot therein.

Moreover, the boot comprising the heel blocking device can be of the front opening type. In all of these types of assembly, the rear part of the upper is provided with padding or quilting for the comfort of the base of the leg, fastened either to the spoiler of the inside slipper. In both of these types of assembly, the block holder is provided so that its height with respect to the spoiler and/or the inside padding can be adjusted, and the stop element is held respectively by that of the spoiler and/or the padding which comprises the adjustment means.

Finally, according to one embodiment which is especially advantageous due to its simple structure, the blocking device is comprised of a block holder, the construction of which is reduced to a transverse bar provided with its blocking means at the ends and placed in its medium with a stop element intended to cooperate with various adjustment positions arranged along the rear of the upper.

BRIEF DESCRIPTION OF THE DRAWINGS

The invention will be understood more clearly by referring to the description below in reference to the attached schematic drawings, which show several embodiments of heel blocking device, by way of illustration.

Figure 1:
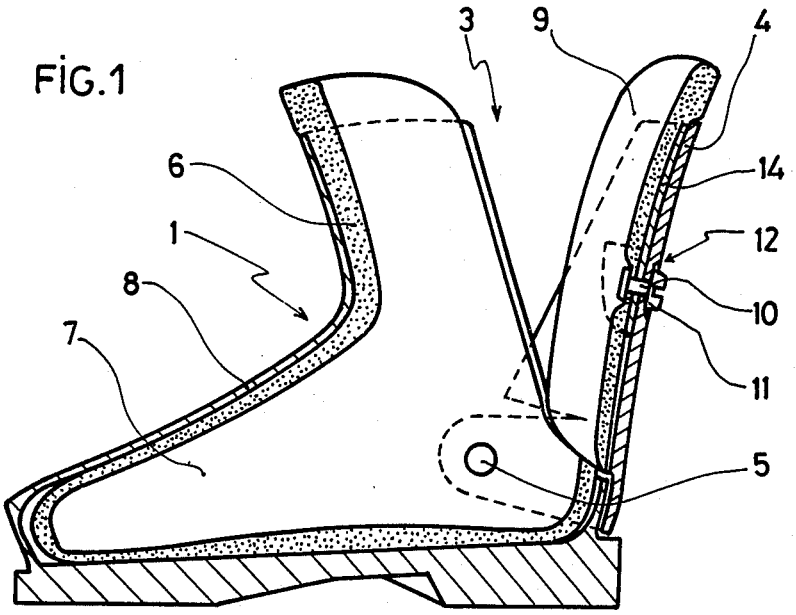
FIG. 1 is schematic longitudinal cross section view of a rear-entry ski boot, provided with a heel blocking device according to the invention.
Figure 2:
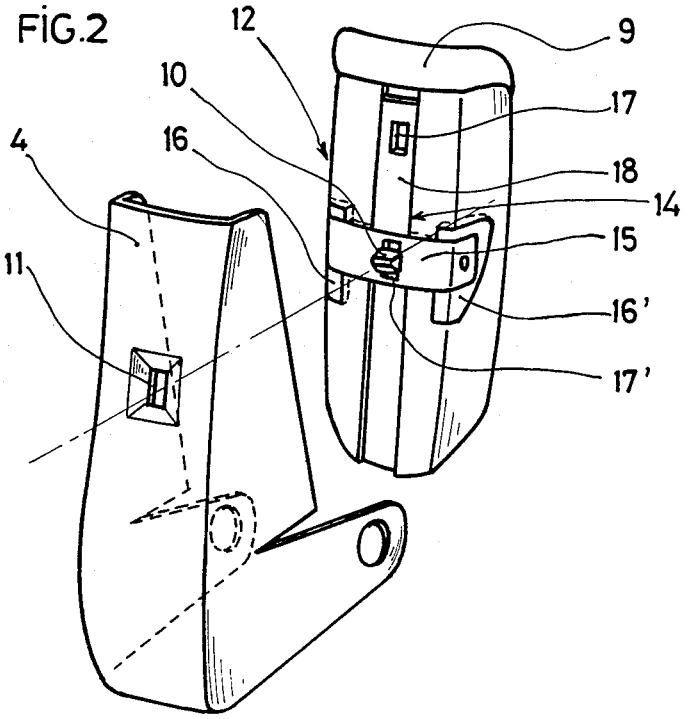
FIG. 2 is an exploded perspective view of the rear part of the boot upper in FIG. 1 with the block holder in a neutral blocking position.
Figure 3:
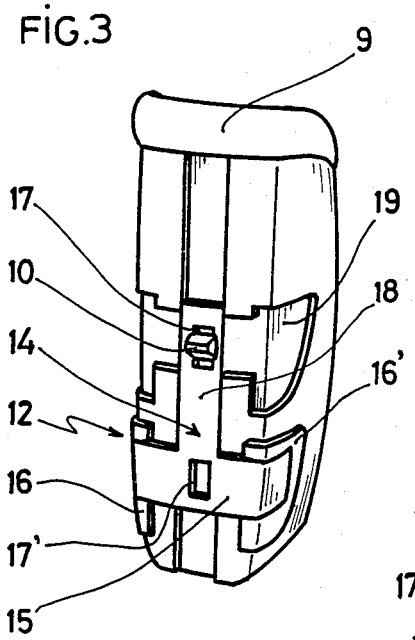
FIG. 3 shows the block holder of FIG. 2 in its blocking position.

FIG. *3a* shows a different embodiment of the blocking device in FIGS. 1 to 3, and said device is provided with a single block extending on both sides of the heel.

Figure 4:
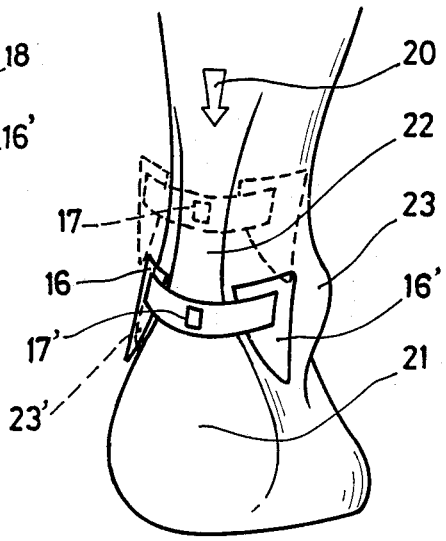

FIG. 4 shows two possible positions for the block holder in the above figures, with respect to the skier's foot.

Figure 5:
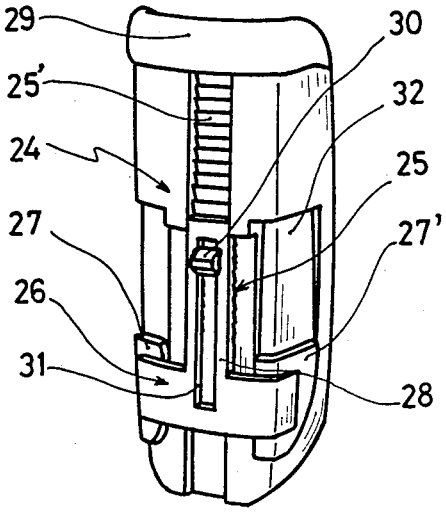

FIG. 5 shows a specific embodiment of the height adjustment means for the block holder, allowing progressive adjustment of the blocking.

Figure 6:
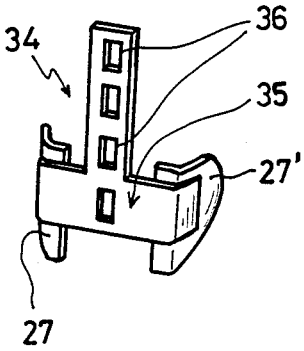

FIG. 6 is a perspective view of a block holder provided with a succession of notches corresponding to the same number of height adjustment positions along an upper (not shown).

Figure 7:
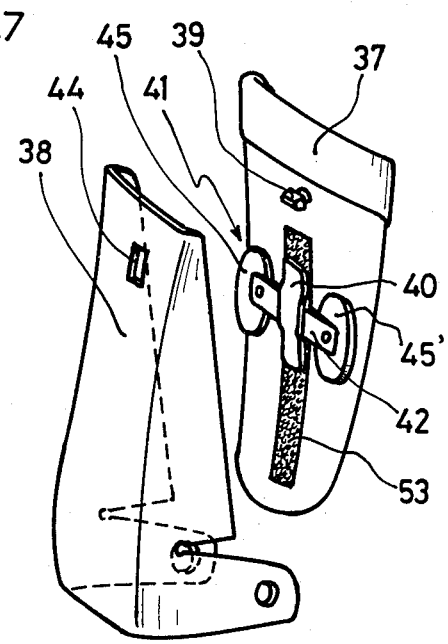

FIG. 7 illustrates a method for connecting the rear support padding to the spoiler, separate from the connection of the blocking device to said padding.

Figure 8:
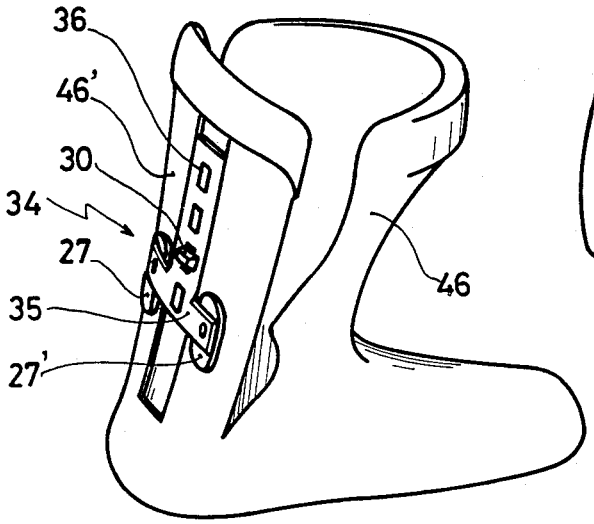
Figure 9:
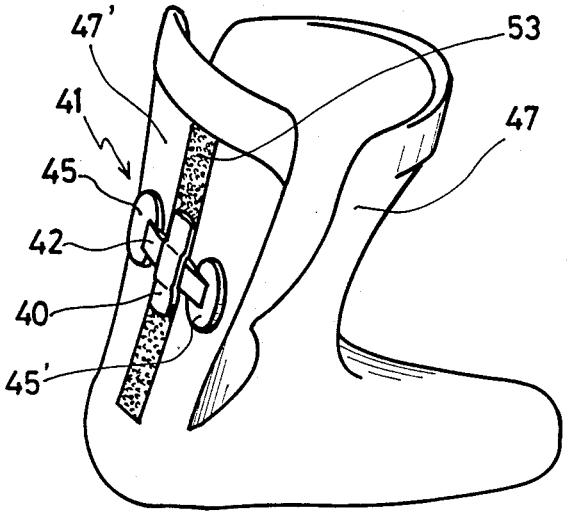
Figure 9:
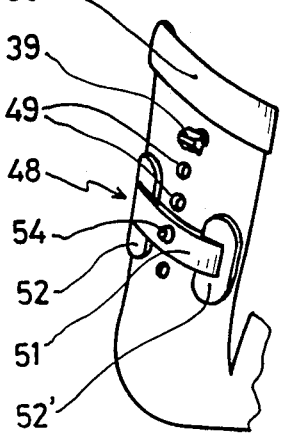

FIGS. 8, 9 and 9 bis are simplified views of inside slippers for the ski boots, each equipped with a different version of a blocking device according to the invention.

FIGS. 10 to 15 show other methods of assembly for the blocking devices according to the invention, connected in these examples to the wall of the rear part of the boot upper.

Figure 10:
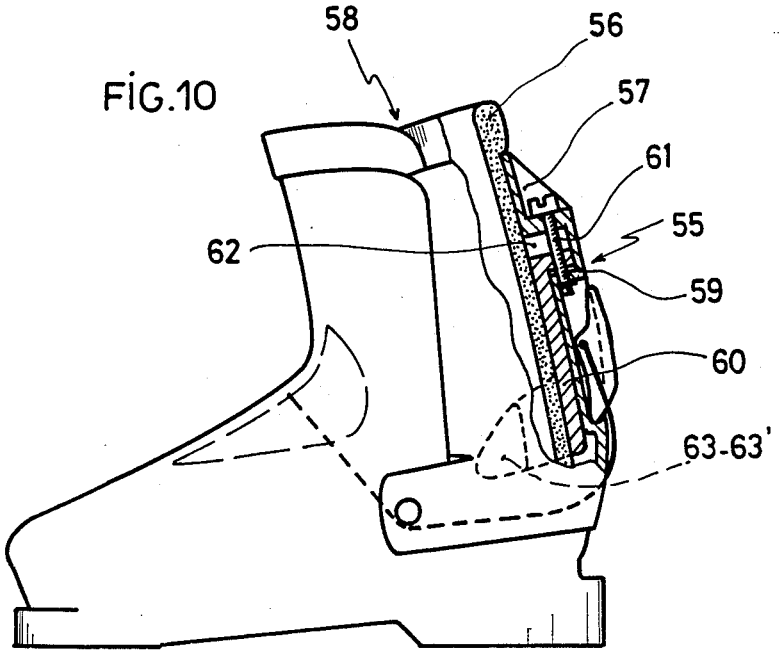
Figure 11:
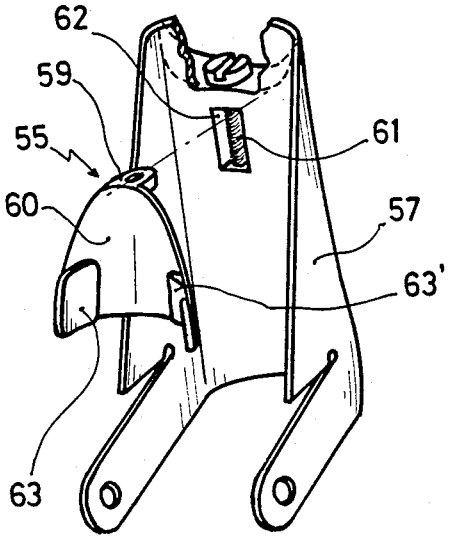

In these examples, FIGS. 10 and 11 show a rear-entry boot, in which the means to adjust the blocking device are comprised of a screw and nut system, with the screw being fixed in the height position on the spoiler and the block holder able to move along this screw.

Figure 12A:
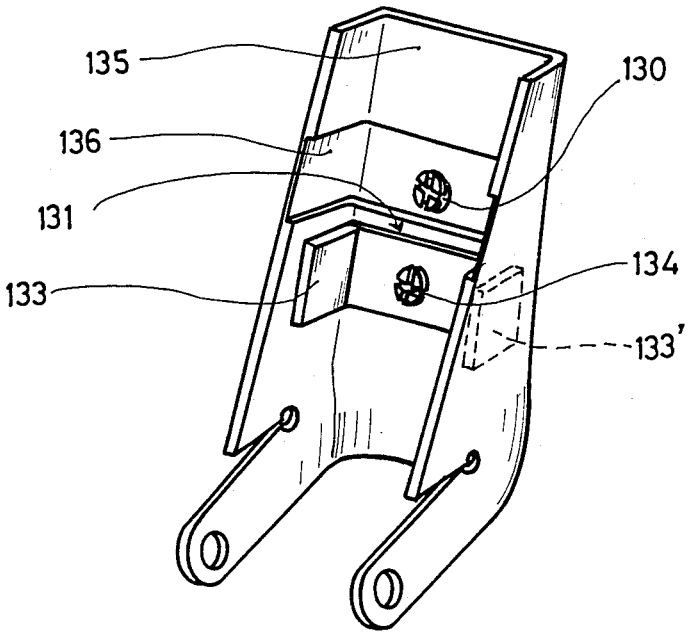
Figure 12:
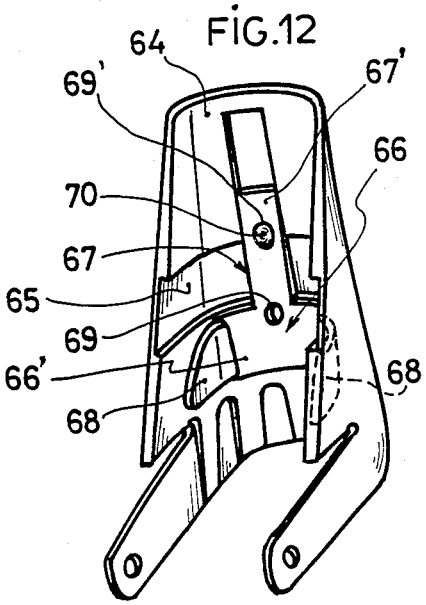

In FIG. 12, the block holder is connected to the spoiler by a stop element attached to the latter and provided, among other things, with a housing corresponding to the block holder for a neutral blocking position.

Figure 13:
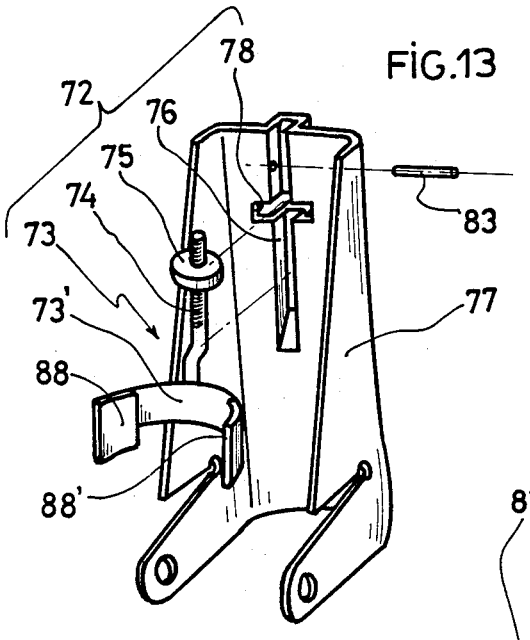

FIG. 13 shows a block holder having a threaded height adjustment shaft which cooperates with a corresponding roller immobilized in translation in a housing made in the wall of the spoiler.

Figure 14:
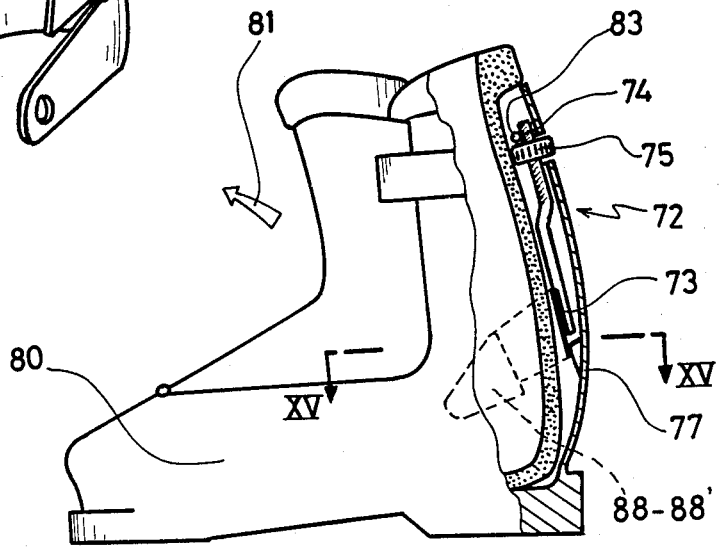

FIG. 14 is another embodiment of the blocking device in FIG. 13, adapted in this example to a front-opening boot.

Figure 15:
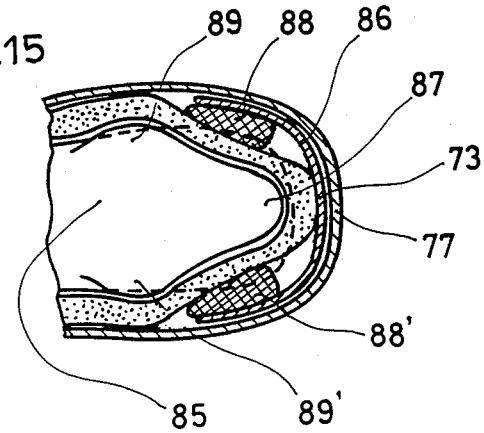

FIG. 15 is cross section along line XV—XV in FIG. 14, providing a schematic view of the position of the blocks with respect to the heel in an active blocking position. FIG. 16, 16*a*, 17 and 18 show three embodiments of a blocking device according to the invention in which the height of the blocks can be adjusted individually.

Figure 16:
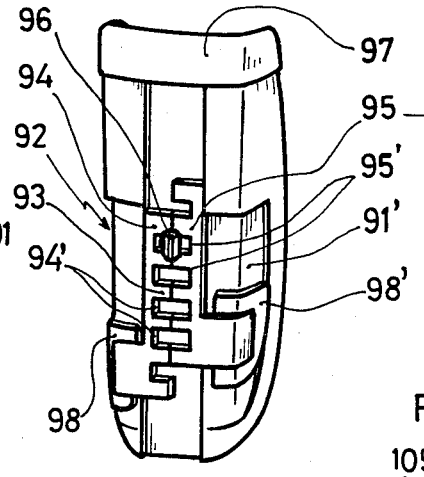
Figure 17:
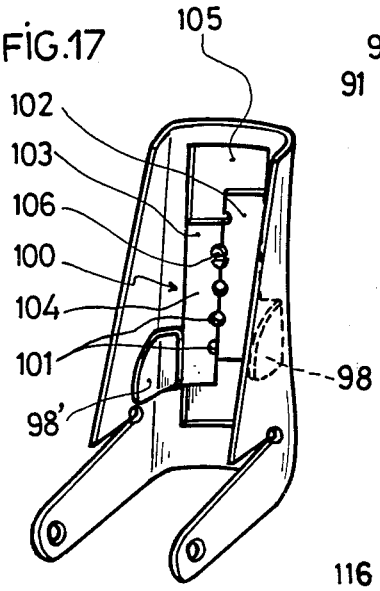
Figure 18:
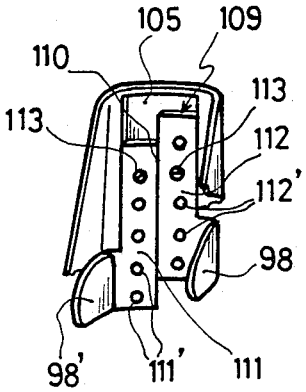

FIG. 18 more especially shows a block holder for a blocking device according to one of the embodiments in FIGS. 16 to 18, but having separate adjustment and stop means.

Figure 19:
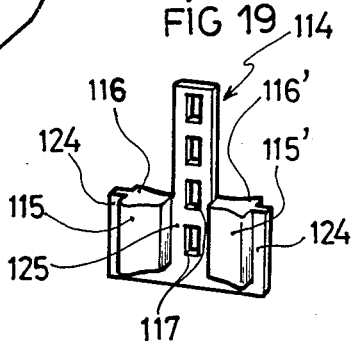

FIG. 19 is a perspective view of another embodiment of the block holder.

Figure 20:
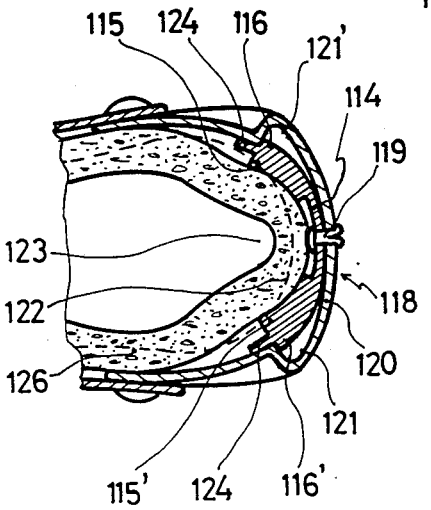
Figure 21:
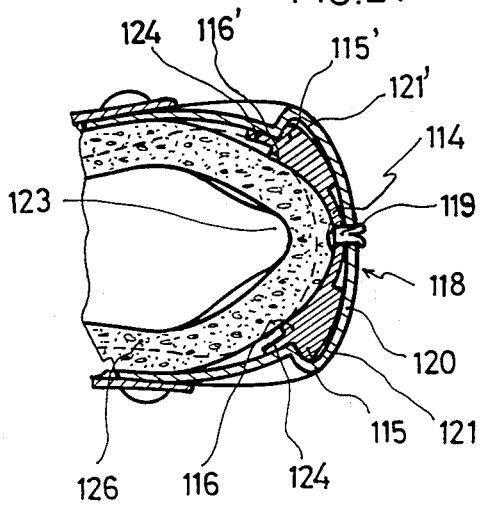

FIGS. 20 and 21 show a schematic cross section along line XV—XV in FIG. 14, of the block holder in FIG. 19, in its active and neutral blocking positions.

DESCRIPTION OF PREFERRED EMBODIMENTS

FIG. 1 is a schematic longitudinal cross section view of a rear-entry ski boot 1, in which the rear part 4 or spoiler of the upper 3 pivots around a transverse axis 5 located in the lower part of the base of the shell 8. In this example, the inside slipper 6 is made in two parts, a front part 7, which is housed in the base of the shell 8, and a rear part 9, constituting the rear padding support 9, which is connected to the spoiler 4 by a stop element 10, fastened in position to the part 9 and hooked to the spoiler 4 through a notch 11 with which the latter is provided (FIG. 2). According to the invention, the blocking device 12 is inserted between the rear support padding 9 for the base of the leg and the corresponding wall of the spoiler 4. In this first embodiment, shown in FIGS. 1 to 3, the blocking device 12 for the heel comprises a block holder 14, generally in the shape of an inverted T, whose horizontal bar 15 is provided at each end with a block 16, 16', and whose vertical bar 18 has two notches 17, 17', thus constituting the height adjustment means along with the stop element 10; each notch determines a blocking adjustment position. Thus, as can be seen in FIGS. 2 and 3, the block holder 14 can be held in an upper position using notch 17', or in a lower blocking position (FIG. 3) using notch 17.

Figure 3A:
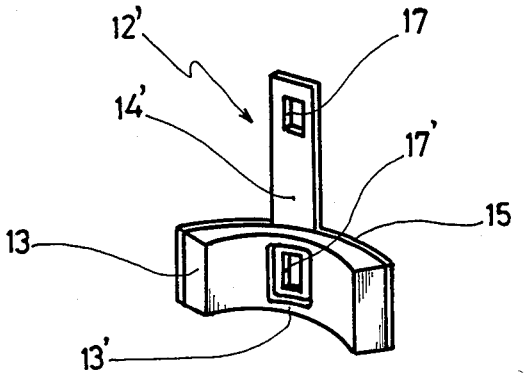

According to another embodiment (FIG. 3*a*), the block holder 14', identical to that described above, has a single block 13 which extends from each side of the zone corresponding to the Achilles tendon. In this case, the block 13 is advantageously made with a substantially pronounced thinning 13' in its median section, intended to bypass the Achilles tendon.

The schematic drawing in FIG. 4 shows the downward movement of the block holder 14 along arrow 20 to a position defined by notch 17, bringing the blocks 16, 16' to press against the upper protuberance of the calcaneum 21, on both sides of the Achilles tendon 22, substantially up to the lower zone of the malleoli 23, 23'. If the skier does not wish to change the blocking conditions for the rear part of the base of the leg on the rear support padding 9 of the upper 3, he maintains the position of the block holder 14 by keeping the blocking elements 16, 16' in a recess 19, whose shape corresponds to said blocks 16, 16', placed in said padding. Thus, the volumes are changed only if the height of the blocking position of the heel is adjusted, as illustrated in FIG. 3.

Another embodiment of the adjustment means for a blocking device 24 is shown in FIG. 5. In this example, a succession of teeth is made in the central part 28 of the block holder 26, between the blocks 17 and 17', while a corresponding opposite locking 25' is produced on the rear support padding 29. The block holder 26 is kept in position with respect to the padding 29 by the stop element 30 which cooperates by hooking through a slot 31 which extends vertically in the central part 28 over length corresponding at least to the end height adjustment positions for the blocking device. A recess 32 to accommodate the blocks 27 and 27' in their initial adjustment position, or neutral position, extends vertically in the direction of the movement of the block holder 26, a direction in which its depth decreases progressively. Thus, the volumes in the heel support zone will change progressively according to the movements effected on the rear support padding 29 by the block holder 26 and its blocks 27, 27'.

A locking device 34 can also be made (FIG. 6) whose block holder 35 is provided with a succession of adjustment notches 36 to cooperate with a stop element of the type described above.

It will be understood (FIG. 7) that the rear part of the slipper, or padding 37, can also be connected to the spoiler 38 through the intermediary of a connection device 39 independent of the stop element 40 of the blocking device 41. In this case, for example, the block holder 42 is provided in its central part with the stop element 40, made of a material with an adhesive texture which cooperates with a corresponding zone 53 placed on the padding 37, while the connection device 39, located outside of the blocking adjustment zone, presses against the padding 37 to be subsequently hooked to the spoiler 38 by introduction and locking through the notch 44. Blocks 45, 45' are attached to the block holder 42 by known means such as gluing, hooking, etc.

Such blocking devices can equally be adapted to a rear part of the slipper, which may or may not be connected to the slipper inside the boot. Thus (FIGS. 8 and 9), the inside slippers 46 and 47 are made unitary with their respective rear support part 46' and 47'. These examples include the adaptation of a blocking device 34, of the type described in FIG. 6, for the slipper 46, and a blocking device 41, of the type described in FIG. 7, for the slipper 47.

On the other hand, still according to the invention, the different height adjustment positions for a blocking device 48 (FIG. 9 bis) can be determined through the intermediary of a succession of holes 49 made in the rear support padding 50 all along the rear height thereof, and a button-shaped stop element 54, intended to lodge in said holes, which ensures the assembly and holding in position of the block holder 51 with its blocks 52, 52', by buttoning.

The embodiments for the blocking devices 41, 34 and 48 presented with references to FIGS. 7 to 9 bis, however, are not limited to "neutral" position housings or cavities located in the padding part, but can be transposed perfectly to cavities suitable to accommodate the blocking elements located in the spoiler, as subsequently shown in FIGS. 10 to 14.

FIGS. 10 to 14 show different methods of adapting the blocking devices according to the invention to the rear part of the upper of a boot and especially to the wall thereof.

Thus (FIGS. 10 and 11), the blocking device 55, inserted between the support padding 56 and the rear part 57 of the upper 58, is connected and its height can be adjusted through the intermediary of adjustment means comprised of a threaded extension 59 connected to the block holder 60 and a screw 61, also forming the stop element, fixed in position on the rear part 57. The blocking is regulated in this example by turning the screw 61, which causes the block holder 60 and the blocks 63, 63' to move up or down. The rear part 57 of the upper is made with a guide housing 62 open towards the inside of the boot and in which the threaded extension 59 of the block holder is lodged. This housing 62 extends along the axis of the adjustment screw 61 and over a length which at least corresponds to the extreme adjustment positions.

In FIG. 12, the rear part 64 (or spoiler) of the upper of the boot comprises a cavity 65 placed on its inside surface against which the rear tongue of an inside slipper presses. The shape of this cavity 65 is approximately complementary to that of the block holder 67 intended to be lodged therein. This shape is constituted by to zones: a vertical groove extending along the median axis of the spoiler and intended to accommodate a median tongue 67', and the other extending substantially over the internal periphery of said spoiler 64 and juxtaposed under the preceding one to receive the transverse bar 66' holding the blocks 68, 68'. The neutral blocking position is obtained when the notch 69 located at the bottom of the tongue 67' is locked on the stop element 70 comprised of a clip button attached to the bottom of the vertical groove, so that the block holder 67 is totally concealed in the cavity 65. Finally, the active blocking position is obtained by moving the block holder 67 outside of the cavity 65, and the tongue 67' locks on the button 70 with its upper notch 69'. Obviously, other notches can be inserted between the end positions 69, 69' for a more precise adjustment.

FIG. 12*a* shows another embodiment of a blocking device 131 adapted to the rear part 135 (or spoiler) of the upper of a boot; in this case, the height of the block holder 132 can be adjusted in different blocking positions through the intermediary of several elastic holding buttons 130, connected to the rear part 135, which cooperate with a clipping hole 134, made in said block holder 132. As in the example in the preceding FIG. 12, a neutral blocking position is achieved using a cavity 136 in which the block holder 132 and its blocks 133, 133' can be lodged.

FIG. 13 illustrates another embodiment of a blocking device 72, which comprises a block holder 73 made up of a transverse bar 73' at the ends of which the blocks 88, 88' are attached, and a threaded shaft 74 attached to said bar in a known manner. This threaded shaft defines a double bend allowing it to lodge in a housing 76 placed in the spoiler 77. The walls of this housing extend vertically along the median axis of said spoiler and are interrupted by an opening 78 so that a milled screw 75 can be inserted, thus facilitating the moving action of the block holder 73 from the outside of the boot. A transverse pin 83 holds the threaded shaft 74 against the spoiler.

Such blocking device 72 can, of course, be adapted to a boot 80 which opens from the front 81, as can be seen in FIG. 14. The threaded shaft 74 of the block holder 73 is held in place on the rear part 82 of the boot upper as in the preceding figure, using a pin 83 which holds said shaft 74 against the wall of the rear part 82.

FIG. 15 is a detailed view of the blocking of the heel along line XV—XV in FIG. 14. The ankle 85 and the calcaneum 86 are shown schematically. As can be seen, the transverse bar 73' of the block holder 73 surrounds the Achilles tendon 87 and the blocks 88, 88' each extend above the protuberance of the calcaneum up to the corresponding malleolus 89, 89'.

Figure 16A:
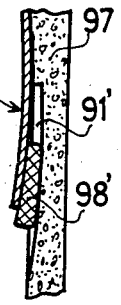

FIGS. 16 and 16*a* illustrate still another embodiment of a blocking device 92. In this embodiment, lateral cavities 91, 91' in the wall of the padding 97 in the rear upper serve as a receptacle for the blocking elements 98, 98' which can thus occupy a neutral blocking position, then an active position, because of the progressive variation in the depth of said cavities 91, 91'. The block holder 93 of the device 92 is comprised of two generally L-shaped symmetrical parts 94, 95, mutually juxtaposed by their respective vertical L bars. The height adjustment means are comprised of notches 94' and 95' made in both of the corresponding parts 94 and 95, opposite and equidistant, to cooperate with a common stop element 96, fixed in place on the rear support padding 97. The stop element 96 is introduced through notches 94' and 95' provided in a corresponding manner, then is turned 90 degrees so that it simultaneously covers the two L-shaped parts 94 and 95 of the block holder 93. Such an embodiment makes it possible to adjust the height of the blocks 98 and 98' independently of each other.

FIG. 17 shows a blocking device 100 which is similar to the device 92 just described with reference to FIG. 16, but associated this time with the inside surface of the spoiler 105 of the boot upper. In this case, the height adjustment means are comprised of holes 101 which overlap two separate parts 102 and 103 of a block holder 104. A flexible clip or hook 106, attached to the spoiler 105, stops and maintains the block holder 104 in a given position.

Obviously, the height adjustment and stop means for the two separate parts of a block holder can also be separate instead of common thereto. Thus, for example, FIG. 18 shows a blocking device 109 in which the block holder 110 is comprised of two symmetric parts 111 and 112 which can be adjusted and immobilized independently of each other through the intermediary of two parallel series of hooking and stop means, respectively 111' and 112', each intended to cooperate with an elastic hook 113. In such an embodiment, the two symmetric parts 111 and 112 can be moved apart since they use their respective adjustment and stop means.

The different blocking devices according to the invention described up to this point with reference to FIGS. 1 to 18 show an adjustment by vertical translation movement along the shaft of the block holder or at least a part thereof. However, FIGS. 19 to 21 illustrate an additional possibility of adjusting the blocking of the heel using a blocking device 118. This additional adjustment possibility is provided by the structure itself of the block holder 114 comprising the blocking device 112. Indeed, this structure allows the volume of the padding to be modified between the heel and the rear upper by the horizontal translation of the blocking elements. In this example, the block holder 114 is made unitary with the blocks 115, 115' and 116, 116' which are symmetrical with respect to the median axis of the boot upper, but with respectively different relief by pair of blocks. According to a preferred embodiment, a series of blocks, for example, 115 and 115', is intended to ensure firm blocking while the other series of blocks, 116, 116', which is thinner, ensures the neutral blocking position.

An edge 124 is made at the end of the transverse bar 125 of the block holder 114, beyond blocks 115, 115', 116, 116', and substantially in the same plane as said bar. As in the previously described examples, the block holder 114 has adjustment means such as notches 117, intended to cooperate with a stop element 119, fixed in position on the rear part 120 of the boot upper. In this example, illustrated in FIGS. 20 and 21, the block holder 114 is connected to the spoiler 120 by the stop element 119. The spoiler 120 is provided with two cavities 121, 121'which extend symmetrically and vertically opposite blocks 115, 115' and 116, 116'. These cavities simultaneously constitute the housing corresponding in volume to that of the thicker blocks 115, 115', and the vertical guide means for said blocks.

Thus, in FIG. 20, the blocking device 118 is shown in firm blocking position, and blocks 115, 115' are turned on the side of the heel 122. In this position, the support edge 124 prevents the block holder 114 from retracting into cavities 121 and 121', and blocks 115 and 115' push back the wall of the inside slipper 126 with a value corresponding to their relief.

Conversely, in FIG. 21, the blocking device 118 is shown in neutral blocking position; in this position, blocks 115, 115' are entirely lodged in cavities 121, 121', and blocks 116, 116', which have a low degree of relief, simply ensure the continuity of the support system of the inside slipper 126 constituted by the spoiler 120. Of course, blocks 116, 116' may have a greater relief and thus provide a second active blocking position different from the one obtained through the intermediary of blocks 115, 115'. Further, the block holder 114 may have only one series of blocks 115, 115' and still remain within the scope of the invention.

Finally, the blocks may be made of materials having different mechanical characteristics or textures, may be made unitary with the block holder, or may themselves be adjustable with respect to position on the block holder, within the scope of the invention.

What is claimed is:

1. Ski boot comprised of a rigid shell at least partially surmounted by an upper and at least one padding element inside said boot intended to block a foot of a skier, wherein a heel blocking device is displaceably disposed between a padding element and the rear part of the upper, said blocking device comprising, (a) at least one block extending from each side of the zone of the Achilles tendon into the hollow of the malleoli located above the protuberance of the calcaneum;

(b) at least one block holder to which said block is attached; and (c) height adjustment means for said block, located along a median vertical axis of the rear of said upper.

2. Ski boot according to claim 1, wherein said blocking device is fixed in a selected position by at least one stop element connecting said block holder with at least one of said padding element and the rear part of said upper.

3. Ski boot according to claim 2, wherein said blocking device is held by the support padding element to which it is connected through the intermediary of said stop element.

4. Ski boot according to claim 2, wherein said block device is held by the rear part to which it is connected through the intermediary of said stop element.

5. Ski boot according to any one of claims 1 to 4, wherein said height adjustment means are supported by said block holder.

6. Ski boot according to any one of claims 1 to 4, wherein said height adjustment means are supported by said rear padding element.

7. Ski boot according to any one of claims 1 to 4, wherein said height adjustment means are substantially supported by said rear part of said upper.

8. Ski boot according to any one of claims 1 to 4, wherein said height adjustment means are comprised of mutually complementary elements placed respectively on said block holder and on said rear support padding element.

9. Ski boot according to any one of claims 1 to 4, wherein said height adjustment means are supported respectively by said block holder and by said rear part of said upper.

10. Ski boot according to any one of claims 1 to 4, wherein said height adjustment means are comprised of a succession of at least two notches placed parallel to said median vertical axis of said rear of said upper.

11. Ski boot according to claim 8, wherein said height adjustment means are comprised of a succession of cooperating teeth and notches located along said median vertical axis of said rear of said upper.

12. Ski boot according to claim 9, wherein said height adjustment means are comprised of a threaded extension of said block holder which cooperates with an adjustment screw constituting said stop element, and the axis of which is located substantially in the plane of said median vertical axis of said rear of said upper.

13. Ski boot according to any one of claims 1 to 4, wherein said block holder has two blocks which extend on both sides of said median vertical axis of said rear of said upper.

14. Ski boot according to any one of claims 1 to 4, wherein said block extends substantially symmetrically on both sides of said median vertical axis of said rear of said upper.

15. Ski boot according to any of claims 1 to 4, wherein said block holder is comprised of two mutually juxtaposed parts, and each of said parts is provided with at least one block.

16. Ski boot according to claim 15, wherein said parts of said block holder respectively include height adjustment means cooperating with a corresponding stop element.

17. Ski boot according to claim 15, wherein said height adjustment means comprise notches and holes made in an overlapping manner in the juxtaposed parts of said block holder, a single stop element cooperating with said adjustment means acting simultaneously on said parts constituting said block holder.

18. Ski boot according to any one of claims 1 to 4, wherein said block holder is reversible around the median vertical axis of said rear of said upper.

19. Ski boot according to claim 18, wherein said block holder comprises at least one block opposite at least one block which is directed towards a heel of a foot of a skier wearing said boot.

20. Ski boot according to any one of claims 1 to 4, wherein said rear part of said upper comprises, in any support padding and wall of said upper, a cavity having shapes and sizes corresponding at least to those of the blocks which come into position there, for at least one blocking position.

21. Ski boot according to claim 20, wherein the depth of said cavity varies progressively, substantially from the initial height adjustment position of said blocks, where it is greatest, to at least the next height adjustment position of said blocks, where it is smallest.

22. Ski boot according to any one of claims 1 to 4, wherein at least one block is removable from said block holder.

23. Ski boot according to any one of claims 1 to 4, wherein at least one block can be adjusted in position on said block holder.

24. Ski boot according to any one of claims 1 to 4, wherein at least one block is made unitary with said block holder.

25. Ski boot according to any one of claims 1 to 4, wherein at least one block has a variable thickness from the Achilles tendon area to the hollow of the malleoli above the protuberance of the calcaneum.

26. Ski boot according to any one of claims 1, 2 and 4, wherein the adjustment of said height of said blocking device is accessible from the outside of said rear part of said upper through the intermediary of said stop element which projects on the latter through its movable part.

* * * * *